United States Patent [19]

Orthwein

[11] Patent Number: 4,478,290

[45] **Date of Patent: * Oct. 23, 1984**

[54] ANTI-BUCKLING DEVICE FOR MINE-ROOF BOLTING MACHINES

[76] Inventor: William G. Orthwein, P.O. Box 3332, Carbondale, Ill. 62901

[ * ] Notice: The portion of the term of this patent subsequent to May 11, 1999 has been disclaimed.

[21] Appl. No.: 424,446

[22] Filed: Sep. 27, 1982

Related U.S. Application Data

[60] Continuation-in-part of Ser. No. 296,369, Aug. 26, 1981, Pat. No. 4,371,040, which is a division of Ser. No. 020,117, Mar. 13, 1979, Pat. No. 4,328,872.

[51] Int. Cl.[3] ..... B23Q 15/00; F21C 5/16

[52] U.S. Cl. ..... 173/11; 173/38; 173/160; 175/27; 408/6; 408/11

[58] Field of Search ..... 173/4, 11, 160, 38; 356/4, 372, 373, 375; 250/561; 408/6, 11; 175/27

[56] References Cited

U.S. PATENT DOCUMENTS

| | | | |
|---|---|---|---|
| 2,437,608 | 3/1948 | Long et al. | 356/373 |
| 3,724,559 | 4/1973 | Strommes | 173/4 |
| 3,918,814 | 11/1975 | Weiser | 356/375 |
| 4,049,965 | 9/1977 | Pettigrew | 356/373 |
| 4,320,462 | 3/1982 | Lund et al. | 356/375 |
| 4,328,872 | 5/1982 | Orthwein | 173/160 |

FOREIGN PATENT DOCUMENTS

| | | | |
|---|---|---|---|
| 2654020 | 6/1978 | Fed. Rep. of Germany | 356/373 |
| 7707140 | 1/1979 | Switzerland | 173/13 |
| 10760 | of 1915 | United Kingdom | 356/373 |
| 8208682 | 9/1982 | United Kingdom | 356/373 |

*Primary Examiner*—Frank T. Yost
*Assistant Examiner*—Hien H. Phan
*Attorney, Agent, or Firm*—Schwartz, Jeffery, Schwaab, Mack, Blumenthal & Koch

[57] ABSTRACT

The invention comprises generally apparatus for use with an underground mine-shaft roof-bolting machine having a torque motor, a pinning rod held for rotation by the torque motor, a controllable arrangement for exerting upward thrust on the torque motor to force the pinning rod upwardly into the roof of a mine shaft, and a manual control for the upward thrust arrangement. An infrared source is held stationary with respect to the rod, and a detector moves upwardly with the rod. The detector receives radiation from the source and emits a signal which varies in accordance with the source to detector distance. This signal is used to control the upward thrust applied to the torque motor in accordance with the length of a pinning rod exposed below the roof being bolted. In one embodiment, the detector produces a signal based on the intensity of the received light. In another embodiment, the light is focused on the detector, which comprises a plurality of photodetectors and the signal produced is based on the number of detectors struck by the light.

8 Claims, 21 Drawing Figures

ANTI-BUCKLING DEVICE FOR MINE-ROOF BOLTING MACHINES

This is a continuation in part of U.S. application Ser. No. 296,369, filed Aug. 26, 1981, now U.S. Pat. No. 4,371,040 which is a division of Ser. No. 020,117, filed Mar. 13, 1979, now U.S. Pat. No. 4,328,872.

BACKGROUND OF THE INVENTION

1. Field of the Invention

The invention relates to safety apparatus for preventing buckling of pinning rods used with underground mine-shaft roof-bolting machines.

2. The Prior Art

Hydraulically-operated roof-bolting machines for underground mine shafts have been known for some time. Such machines typically have a torque motor, a pinning rod held for rotation by the torque motor, a hydraulic device for exerting upward thrust on the torque motor to force the pinning rod upwardly into the roof of a mine shaft, and a device for manually controlling the upward thrust device. Many of the roof bolters which are now commercially available have a hydraulically-operated boom for raising the torque motor, the boom including a linkage arrangement for maintaining the pinning rod in a vertical position. One commercially available roof bolter has a hydraulic cylinder for raising the torque motor, the hydraulic cylinder being here directly mounted on the roof bolter frame or, in some cases, mounted on the end of a hydraulic boom.

In addition, devices are known for hydraulically controlling the rate of pinning-rod infeed so as to increase the drilling rate for softer rock and decrease the drilling rate for hard spots. For example, U.S. Pat. No. 2,320,784 to Lehmann controls the infeed rate and includes a threshold level pressure cutoff which stops the infeed when the pressure in the feed cylinders builds up beyond a predetermined level.

Another type of automatic feed-pressure regulator is shown in U.S. Pat. No. 2,322,741 to Osgood. In this device, the feed control means is automatically responsive to variations in the resistance to drill bit penetration. An arrangement for providing optimum feed force to the mining drill in a pneumatic system is shown in U.S. Pat. No. 2,754,804 to Miller.

SUMMARY OF THE INVENTION

Roof bolting is necessary because U.S. mining practice is to use passages of rectangular cross section in underground mining, which induces failure of the rock near the center of the passage. Regulations, therefore, require the mining company to insert bolts ranging in length from 2 to 8 feet in the mine roof at regular intervals to keep the rock in place. These bolts are installed by a machine which uses a bit and a long extension shank, often called a pinning rod, to first drill a hole in the roof and to then insert a long bolt with an expansion anchor on the upper end. Buckling of the pinning rods during the pinning operation is common because the bolting machines can exert enough thrust to easily bend the pinning rod as it begins to drill into the mine roof. Although the insertion thrust may be manually controlled by the operator, bolting machines have proven to be dangerous and, in numerous cases, machine operators have been seriously injured or even killed as the pinning rods have buckled.

The present invention is directed to the concept of eliminating or, at least, reducing the possibility of buckling of the pinning rod as used in underground roof bolting. This end is accomplished by use of a variable relief valve to limit the axial thrust that can be applied to the pinning rod by the bolting machine.

In a first embodiment of the invention, an appropriately contoured cam is connected to the roof bolting machine such that it rotates in dependence on the elevation of the torque motor relative to the bolting machine. A cam follower connected to suitable limiting means detects the position of the cam and results in variable automatic control of the maximum upward thrust on the torque motor in dependence on the elevation of the torque motor. Thus, as the torque motor is raised and the exposed portion of the pinning rod decreases, the maximum allowable axial thrust on the pinning rod is increased. The means for limiting the upward thrust may comprise a hydraulic relief valve which may be fixed in position relative to the cam if the roof-bolting machine is used only in mine shafts having constant roof height, or the valve may be mounted for adjustment, in which case the range of elevations of the torque motor for which the device is effective may be varied according to roof height.

In a second embodiment of the invention, a non-linear spring arrangement is substituted for the contoured cam means such that the activation pressure applied to the relief valve varies with the elevation of the torque motor. In a preferred variation of this embodiment the non-linear spring comprises a Belleville spring assembly.

In a third embodiment of the invention, a light beam is projected along the length of and substantially parallel to the pinning rod, such that buckling of the pinning rod causes interruption of the light beam and a resultant disabling of the means for providing upward axial thrust on the pinning rod.

A fourth embodiment employs a Scotch yoke and pin arrangement to control the thrust limiting means in dependence on the elevation of the torque motor.

A fifth embodiment employs an infrared source and an infrared detector. The detector produces a signal which varies in accordance with the source-to-detector distance. This signal is used to control the upward thrust applied to the pinning rod.

DETAILED DESCRIPTION OF THE PREFERRED EMBODIMENTS

Figure 1:
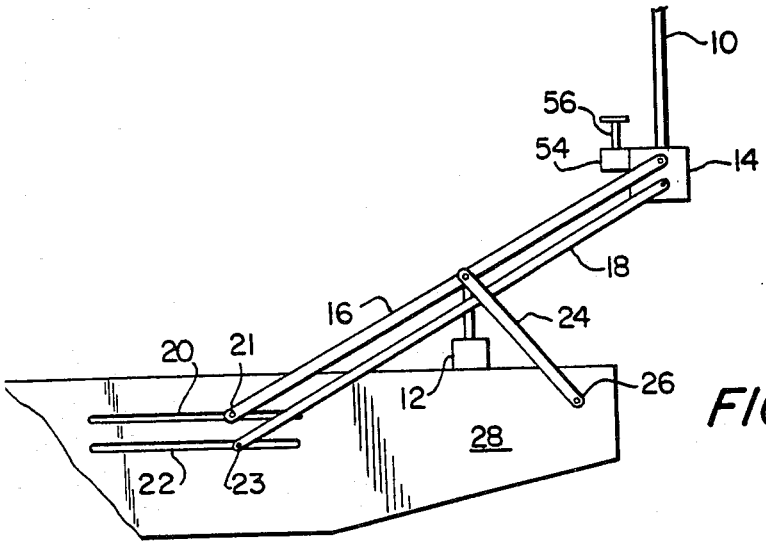
FIG. 1 illustrates the essential elements of one type of commercially available mine-roof bolting machine, with partial modification for use with the present invention, in elevation.

FIG. 1 shows in partial elevation the linkage used in one commercially available roof bolter to elevate the torque motor, pinning rod, and bit. Pinning rod 10 (also called a drill rod) is forced upwardly into a mine roof (not shown) under thrust from cylinder 12, the bit (not shown) and drill rod 10 being rotated by a torque motor 14. Main boom members 16 and auxiliary boom members 18, located on both sides of the torque motor, have their respective upper ends pivotably connected to the side of torque motor 14 and their lower ends respectively mounted on shafts 21, 23, respectively, for pivotal sliding motion in tracks 20 and 22. A forward link 24 is pivotally mounted at one end to boom 16 and is mounted for rotation at the other end about a stub shaft 26 on the frame 28 of the roof bolter.

Figure 2:
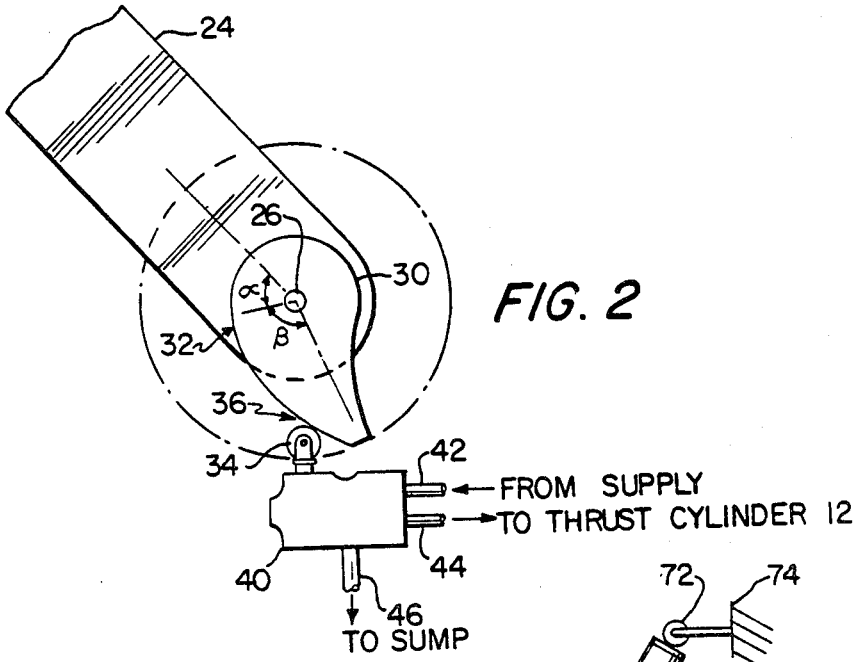
FIG. 2 is a partial elevation of the roof-bolting machine of FIG. 1, with modification according to a first embodiment of the invention.
Figure 4:
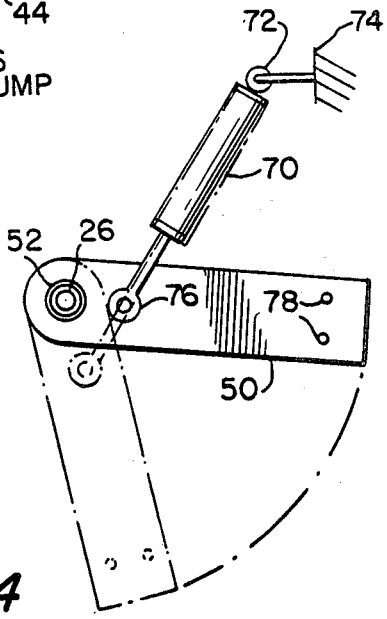
FIG. 4 shows in elevation additional components of the arrangement of FIG. 3 which are not shown in FIG. 3.

Because shaft 26 does not translate relative to the roof bolter frame, a cam 30, as shown in FIG. 2, is welded or otherwise rigidly attached to the outside of forward link 24 so that it rotates coaxially with link 24 about shaft 26. Cam 30 is oriented with respect to the center line of forward link 24 such that the lowest upward thrust from cylinder 12 is permitted when point 32 is in contact with cam follower 34, i.e., generally when link 24 is at or below the horizontal, depending upon the particular machine design. The greatest upward thrust permitted by cylinder 12 occurs when link 24 and cam 30 have rotated about shaft 26 until cam follower 34 is in contact with point 36 of the cam, as shown in FIG. 2. This corresponds to the uppermost position of torque motor 14 and the clockwise-most position of forward link 24. Relief valve 40 is either rigidly attached to bolter frame 28, for machines to be used in constant heights seams, or to a movable arm 50, as illustrated in FIG. 4, for machines to be used in variable height seams. Cam follower 34 controls the relief pressure of valve 40 and thereby controls pressure from hydraulic supply line 42 through hydraulic line 44 to thrust cylinder 12 of FIG. 1. Depending upon the particular type of relief valve used, a sump return line 46 may be provided.

Figure 3:
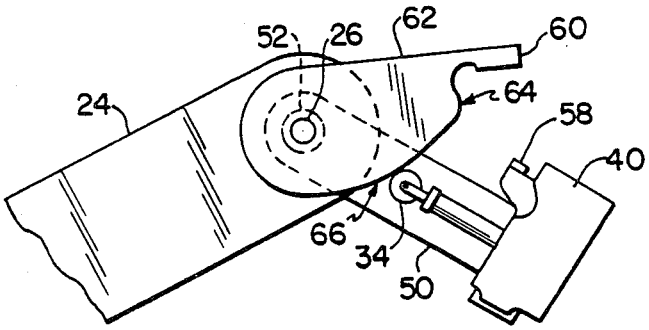
FIG. 3 is a partial elevation of the roof-bolting machine of FIG. 1, with modification according to a variation of the first embodiment.
Figure 5:
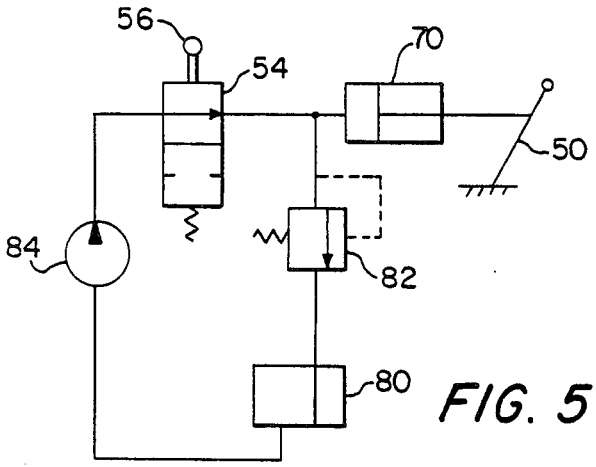
FIG. 5 shows a schematic hydraulic indexing circuit for use with the embodiment of FIGS. 3 and 4 and the embodiment of FIG. 11.

Adjustment may be made for variable mine roof height with the arrangement shown in FIGS. 3 and 4 and the associated hydraulic circuit of FIG. 5. This requires that relief valve 40, also known as a pilot-operated pressure control valve, be mounted on an arm 50 which is in turn mounted on bearings 52 on the stub shaft 26 about which link 24 rotates. Arm 50 is, however, free to turn independently of the rotation of link 24. The operation of arm 50 and the associated mechanism is best explained in a series of operational steps.

Step 1: The pilot drill, which is a short drill for making a shallow hole in the roof so that the bit on the longer pinning rod to be used next can start into the pilot hole and not skid to one side as thrust is applied, is inserted in the thrust motor and the thrust motor is raised to a position just below the mine roof. A valve 54, affixed to the thrust motor as shown in FIG. 1, has an operating rod 56 which makes contact with the mine roof and causes valve 54 to open. This in turn causes cylinder 70 (FIG. 4) to retract and to rotate arm 50, on which relief valve 40 is attached, in the counterclockwise direction until stop 58 contacts stop 60 of cam 62. Thus, cam follower 34 is at point 64 on cam 62 and maximum pressure is permitted to the thrust cylinder 12 of FIG. 1. When boom 16 of FIG. 1 is lowered, the spring-loaded operating rod 56 of valve 54 returns to its closed position, closing the hydraulic lines to cylinder 70. Thus, arm 50 and, with it, valve 40, is fixed in position relative to the bolter frame and relative to shaft 26. As boom 16 is lowered, link 24 and, with it, cam 62, rotate counterclockwise and cam follower 34 moves from point 64 toward, but not necessarily to, point 66 on cam 62. The rest position between points 64 and 66 determine the maximum initial thrust available as the boom is once again raised in step 3, below.

Step 2: The boom is lowered, with arm 50 and relief valve 40 hydraulically locked in position relative to bolter frame 27 by cylinder 70.

Step 3: The short pilot drill is removed from torque motor 14 and replaced by a long pinning rod 10. Relief valve 40 remains locked in position relative to bolter frame 20 so that the pressure available to the thrust cylinder 12 increases as the boom 16 rises because cam follower 34 is now moved to point 64 as cam 62 and link 24 rotate clockwise about shaft 26. The contour of cam 62 is designed such that the upward axial thrust on pinning rod 10 is limited sufficiently to prevent buckling of the pinning rod. If the torque motor is raised sufficiently for the operating rod 56 of indexing valve 54 to contact the roof again, valve 40 may be slightly repositioned as the indexing system is activated. This is, however, of no consequence because it will not reduce the maximum thrust that is available since any motion of the indexing system will simply bring cam follower 34 closer to point 64 on the cam.

Step 4: The main boom is lowered as in Step 2. After the boom is lowered, the bolting machine may be moved to a new position in the mine. Step 1 above relocates cam follower 34 along the countour of cam arc 64–66. The length and contour from point 64 to point 66 is determined by the maximum possible upper and lower positions of boom 16 and, therefore, link 24.

If the bolting machine moves from a lower roof to a higher roof, forward link 24 and cam 62 will rotate clockwise until stop 60 of cam 62 contacts stop 58 mounted on relief valve 40, forcing arm 50 to move clockwise. This, in turn, will tend to extend cylinder 70. The increased pressure in cylinder 70 will cause hydraulic fluid to return to sump 80 through relief valve 82, set to a relief pressure slightly higher than that delivered by low pressure hydraulic pump 84 (see the schematic hydraulic indexing circuit of FIG. 5).

Figure 6:
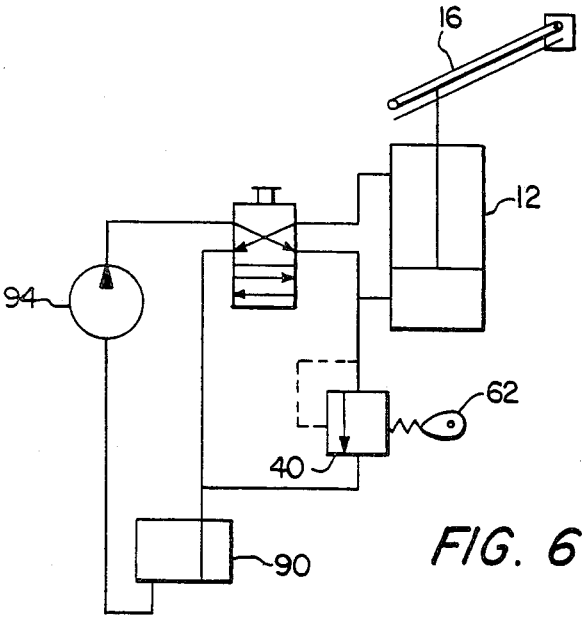
FIG. 6 shows a schematic hydraulic circuit for providing the upward axial thrust on the pinning rod, with means to prevent buckling of the pinning rod.

Referring now to the schematic hydraulic thrust circuit of FIG. 6, thrust cylinder 12 raises boom 16 when hydraulically actuated. Pressure relief valve 40 controls the maximum pressure to thrust cylinder 12, wherein the position of cam 62 determines the pressure required to open valve 40 to the sump 90. In this schematic, pump 94 is a high pressure hydraulic source. Since pump 84 of FIG. 5 is low pressure, it may be replaced by a line from pump 94 and a pressure reducer. An operator control valve 100 is provided for raising and lowering boom 16.

Figure 7:
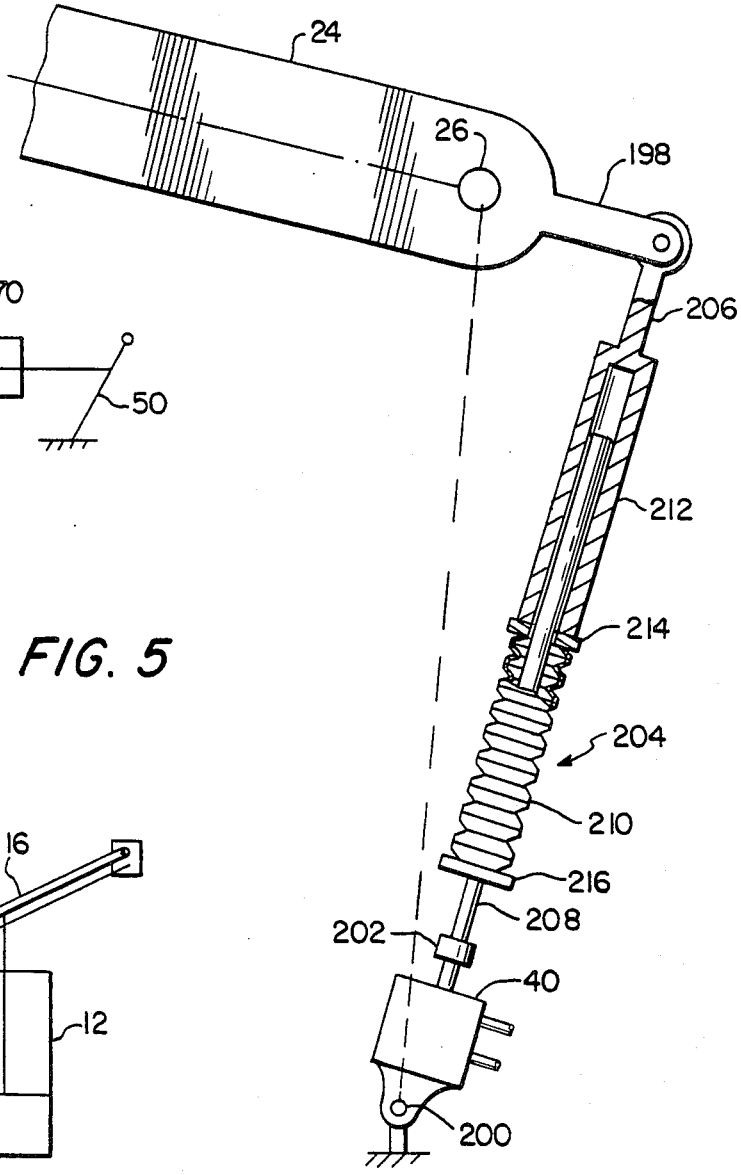
FIG. 7 shows in partial elevation a second embodiment which utilizes a non-linear spring to control thrust in dependence on the elevation of the thrust motor.
Figure 8:
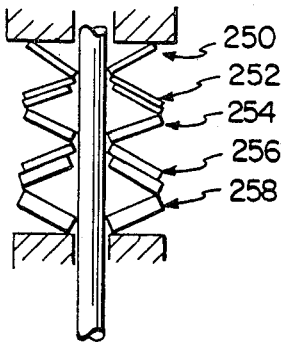
FIG. 8 is a partial cross-sectional elevation of a non-linear spring for use in the embodiment of FIG. 7.
Figure 9:
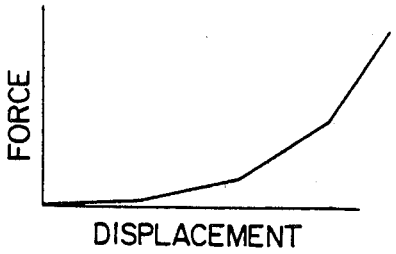
FIG. 9 shows the force-vs.-displacement characteristic of the non-linear spring of FIG. 8.

A further embodiment of the invention will now be described with reference to FIGS. 7, 8 and 9. As an alternative to the use of a cam to control pressure relief valve 40 and thereby regulate the upward thrust of cylinder 12 as a function of boom position (and, hence, exposed pinning rod length), a non-linear spring assembly is used. In this embodiment, an arm 198 extends from the end of forward link 24 radially outward from shaft 26. Relief valve 40 is attached to a rotating pivot 200 which is fixed to the frame of the bolting machine. The operating stem of the pilot-operated pressure control valve 40 is suitably connected at 202 to the end of extension arm 208. Extension arm 208 forms the lower member of a telescoping, spring-loaded link assembly shown generally at 204. The assembly 204 comprises a sleeve link 206, plunger link 208, having a cylinder 212 and a Belleville spring assembly 210. Link 206 is concentric with and partially slides over extension arm 208. Force is applied by cylinder 212 on extension arm 208 through shoulder 214, through a series of disk springs 210, and through shoulder 216 on extension arm 208.

Belleville, or disk, springs provide the capability of designing non-linearity into the spring to satisfactorily approximate the buckling force on a pinning rod. For example, a stack of disk springs as shown in FIG. 8 produces a spring assembly having a force-vs.-displacement characteristic as shown in FIG. 9. Relatively little force is required to flatten spring 250, more force is required to flatten springs 252, and increasingly greater forces are required to flatten spring 254, springs 256, and spring 258, respectively. Varying the thickness and the relative positioning of the individual Belleville springs, as shown in FIG. 8, results in a force-vs.-displacement characteristic composed of straight-line segments.

Figure 10:
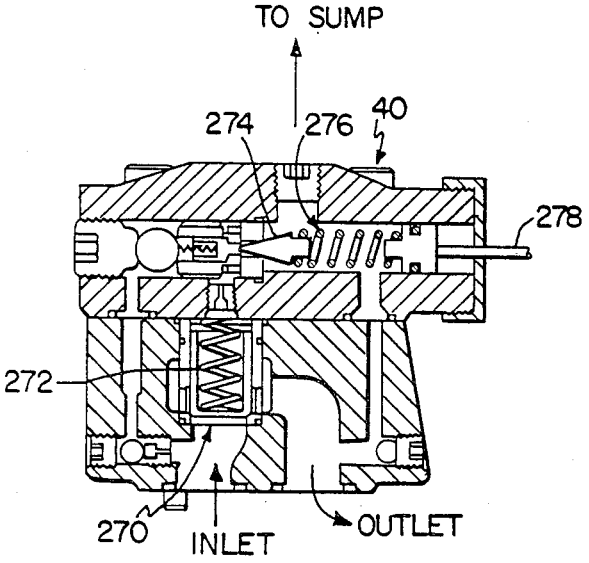
FIG. 10 illustrates in elevational cross section a particular type of hydraulic relief valve which may be used in the embodiments of the present invention.

As mentioned above, relief valve 40 is preferably a pilot-operated pressure-control valve. While any suitable type of valve which serves the necessary function may be used for valve 40 in the embodiments of FIGS. 2, 3 and 6, it is preferred to use an ABEX-DENNISON valve type R4V configured as shown in FIG. 10. As the valve is provided by the manufacturer, tension on pilot spring 276 is adjustable by a hand control knob, which can be replaced as shown in FIG. 10 by a suitable shaft 278 to which cam follower 34 of FIGS. 2 and 3 or extension arm 208 of FIG. 7 may be attached for operation.

The ABEX-DENNISON relief valve consists of two integral valve sections: a high-flow pilot-operated poppet section 270 beneath, controlled by low-flow, adjustable spring-loaded cone section 274 on top. Spring 276 biases cone 274 in its seated position.

The relief valve may be connected with inlet and outlet connections as shown, and may also be connected to a sump return line where indicated. The high-flow poppet in the relief valve is controlled by the spring-loaded cone, flow entering at the inlet being blocked by the poppet at low pressure. The pressure signal at the inlet passes through orifices to the top side of the poppet and to the cone, and there is no flow through these sections until the pressure rises to the maximum permitted by the spring-loaded cone adjustably set by the position of stem 278. This limits the topside pressure on the poppet.

If the inlet pressure attempts to rise above that, main poppet 270 lifts, passing only enough flow from the inlet to the outlet to keep the inlet pressure at the set value. Main poppet 270 closes instantly when the inlet pressure drops below that value. Control cone 270 is forced off its seat by the pilot signal which flows through orifices around the control block. The control piston acts as a dash-pot to damp oscillations of the cone.

Figure 11:
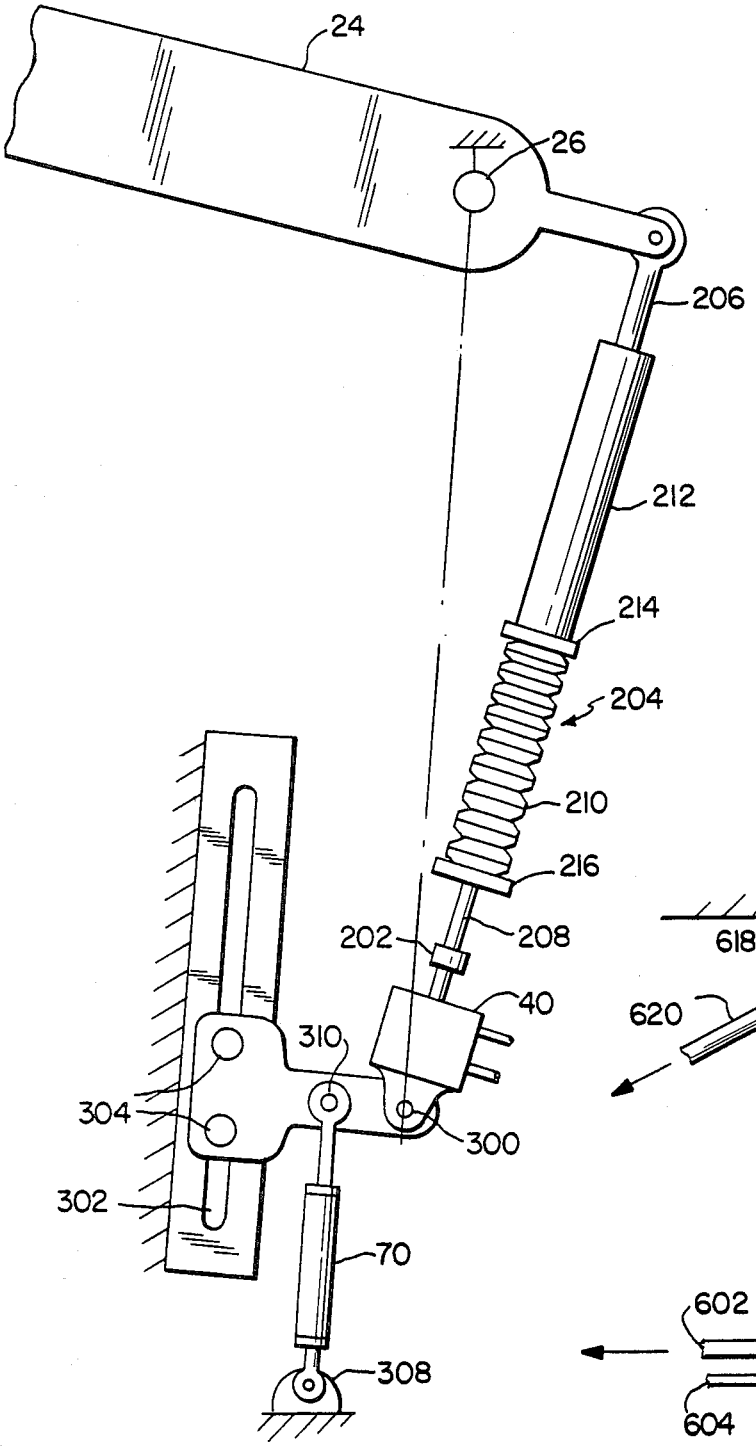
FIG. 11 is a partial elevation of a variation of the embodiment of FIG. 7.

Referring now to FIG. 11, a variation of the embodiment of FIG. 7 will now be described. While the embodiment of FIG. 7 is shown fixed for a specific mine roof height, roof height variation may be accounted for if the non-linear spring assembly is adjustably tensioned by mounting relief valve 40 pivotably at 300 on a sliding support member which is secured by pins 304 in a track 302. Track 302 is secured to frame 28 of the roof-bolting machine (see FIG. 1). The center line of track 302 is parallel to a line through the axis of shaft 26 and the axis of pivot 300. The sliding support member is positioned by means of a hydraulic cylinder 70 which compares with hydraulic cylinder 70 in FIG. 4. The schematic hydraulic indexing circuit of FIG. 5 applies also to the embodiment of FIG. 11, with indexing valve 54 mounted on or near the torque motor as before. When the mine roof height decreases, movable relief valve 40 and pivot point 300 are driven upwardly by fluid pressure in cylinder 70 until all disks in the spring assembly 204 are flattened. Upon encountering a still higher roof, the disks will become flattened before operating rod 56 of indexing valve 54 reaches the mine roof. Thus, as the forward link 24 continues to rotate clockwise, pressure in adjusting cylinder 70 causes relief valve 82 of FIG. 5 to open so that pivot point 300 and relief valve 40 are moved downwardly until the roof is reached.

Figure 12:
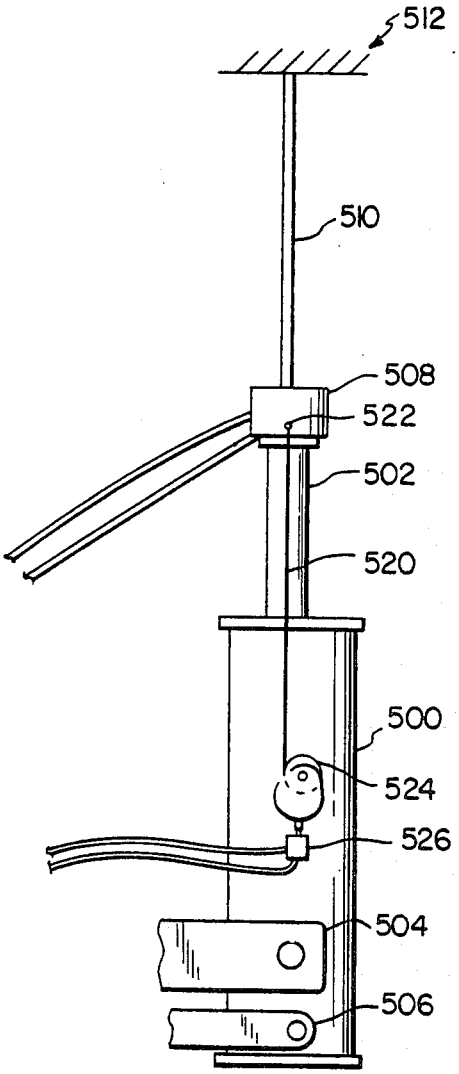
FIG. 12 is a partial elevation of a particular commercially available roof-bolting machine, with modification according to a variation of the first embodiment of the invention.

Still a further embodiment of the present invention is demonstrated in partial elevation in FIG. 12. One particular type of commercially available roof-bolting machine, known as a FLETCHER roof bolter, consists of a hydraulic jack 500 having a piston 502 to which a torque motor 508 is attached. In the most versatile of the FLETCHER roof-bolting machines, the hydraulic jack is carried on the ends of hydraulically-operated main and auxiliary boom members 504 and 506, respectively. Less versatile FLETCHER machines do not have a boom to raise and lower the thrust cylinder. Buckling control is, however, necessary only on the hydraulic cylinder, and it is in control of thrust only when the boom is in the lowered position on the most versatile machine. For either style of machine, cam control of a pressure relief valve 526 (comparable to valve 40 in the foregoing embodiment) may be had by connecting a cable 520 to the upper end of the piston or to the torque motor at 522. The lower end of cable 520 is wound on a spring-loaded drum 524. The drum is then preferably reduction-geared to a cam which regulates the pilot valve of pressure relief valve 526 as in the foregoing embodiments. The reduction gearing may be by means of planetary gearing internal to the drum itself. Valve 526 may be as in FIG. 10.

Figure 13:
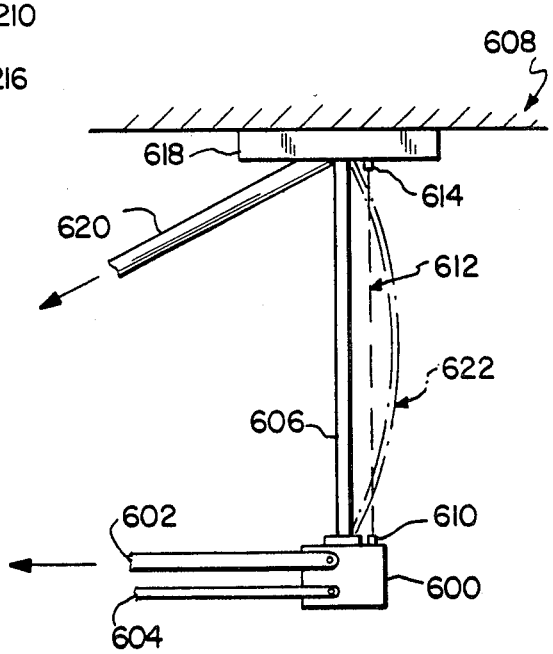
FIG. 13 illustrates in partial elevation a commercially available roof-bolting machine modified according to still a third embodiment of the invention.
Figure 14:
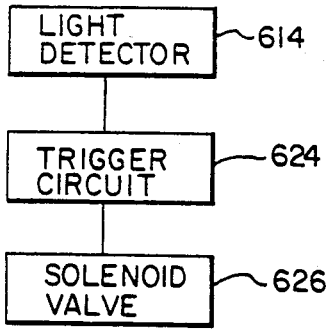
FIG. 14 illustrates schematically a control circuit for use with the arrangement of FIG. 13.

In still a further embodiment of the present invention illustrated in FIGS. 13 and 14, buckling control of pinning rods on either the FLETCHER roof-bolting machines (as seen in FIG. 12) or the other type of commercially available roof-bolting machine (as in FIG. 1) is provided. This is achieved by use of a light beam, either in the visible spectrum or in the infrared spectrum, to detect buckling of the pinning rod. FIG. 13 shows generally the conventional type of bolting machine, having torque motor 600 carried by main boom 602 to an auxiliary boom 604. Pinning rod 606 is held for rotation by the torque motor and is driven by upward thrust of the boom members into mine roof 608. A temporary roof support 618 is provided on the mine roof, and may be carried by a further boom member 620. A light beam projector 610 is mounted on the torque motor and projects a light beam along the length of and substantially parallel to pinning rod 606. The diameter of the light beam is preferably smaller than that of the pinning rod and should be as small as possible, as determined by the capability of the light beam detector 614. The detector, as shown in FIG. 13, is attached to the temporary roof support frame and close to or inside of the hole in the roof support frame to permit the light beam to lie parallel to the pinning rod.

When excessive upward thrust is applied to the pinning rod, sufficient buckling thereof will interrupt the light beam once per revolution. The output of light beam detector 614 is provided to a suitable trigger circuit 624 (FIG. 14) which is preferably sensitive enough to detect a single interruption of the light beam and to, for example, open a solenoid valve 626 which is coupled into the hydraulic line to thrust cylinder 12 (FIG. 1). It is not necessary to provide details of the requisite circuitry here since such circuitry, light sources, light detectors, and solenoid valves are commercially available and well known. Solenoid valve 626 would, of course, readily substitute for relief valve 40 in the hydraulic thrust cylinder circuit shown in FIG. 6.

Figure 15:
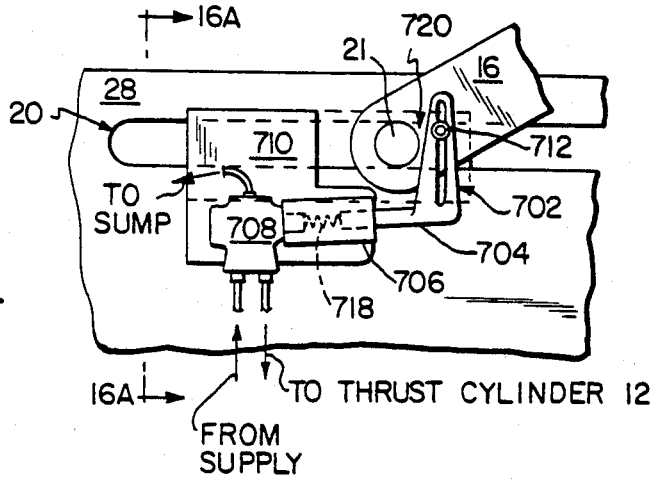
FIG. 15 shows a partial elevation of the roof-bolting machine of FIG. 1, with modification according to a fourth embodiment of the invention.
Figure 16:
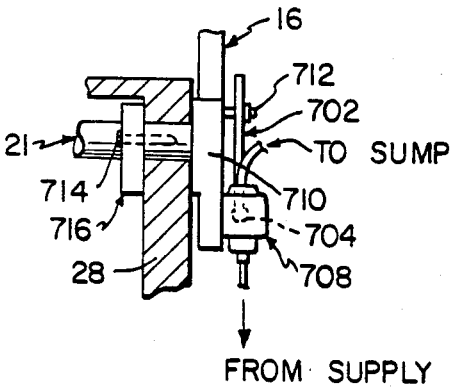
FIG. 16 is a partial cross-sectional view taken along lines 16A—16A of FIG. 15.

Yet another embodiment of the invention is illustrated in FIGS. 15 and 16. FIG. 15 shows in elevational view a part of the frame 28 of the roof bolter of FIG. 1, as well as track 20, shaft 21, and main boom 16. FIG. 16 is a cross-sectional view taken along line 16A—16A of FIG. 15. An offset Scotch yoke 702 has a yoke arm 704 which extends into a guide sleeve 706 mounted on pressure relief valve 708. Valve 708 is preferably a pilot-operated pressure control valve, and may be an ABEX-DENNISON valve configured as shown in FIG. 10. Valve 708 is coupled to a hydraulic supply line, to thrust cylinder 12 of FIG. 1, and to a sump, and can be substituted for valves 40 in the hydraulic circuit of FIG. 6.

Valve 708 is suitably mounted as shown in FIGS. 15 and 16 on a carrier member 710 having a protruding portion which extends into track 20 of the roof bolter frame 28. A retainer plate 716 is attached to carrier member 710 by bolts 714 such that the assembly is slidably retained in track 20. Retainer plate 716 has a U-shaped notch 720 near one end thereof for engaging shaft 21 and causing carrier member 710 and valve 708 to slide with shaft 21 as boom 16 is raised or lowered.

A pin 712 is mounted on the side of boom 16 at a point spaced apart from shaft 21, so that rising or lowering of boom 16 will cause pin 712 to rotate about shaft 21. Scotch yoke 702 has an elongated opening for receiving pin 712, the opening arranged such that yoke arm 704 moves linearly along the horizontal to position the operating stem of valve 708.

The length of yoke arm 704 may be chosen such that the maximum upward thrust of thrust cylinder 12 (FIG. 1) is available when main boom 16 is at such an angle that torque motor 14 (FIG. 1) is, for example, six feet or more above the mine floor. Any buckling of the pinning rod above that height is not as likely to injure the bolting machine operator.

The maximum upward thrust permitted by valve 708 is lowest when main boom 16 is at a lower position and increases as boom 16 is elevated because yoke arm 704 increases the pressure on spring 718, which in turn increases the control pressure on the operating stem of valve 708. This produces a control curve in which the upward axial thrust on the pinning rod is less than that which would cause buckling as the torque motor is forced upwardly. Spring 718 provides a linear force-displacement relation so that the possibly larger displacement of yoke arm 704 may be matched to the smaller permissible displacement of the pilot valve at valve 708. Means for adjusting the arrangement for different roof heights can be made in a manner similar to that shown in FIG. 11.

A still further embodiment of the present invention is shown in FIGS. 17–21.

Figure 17:
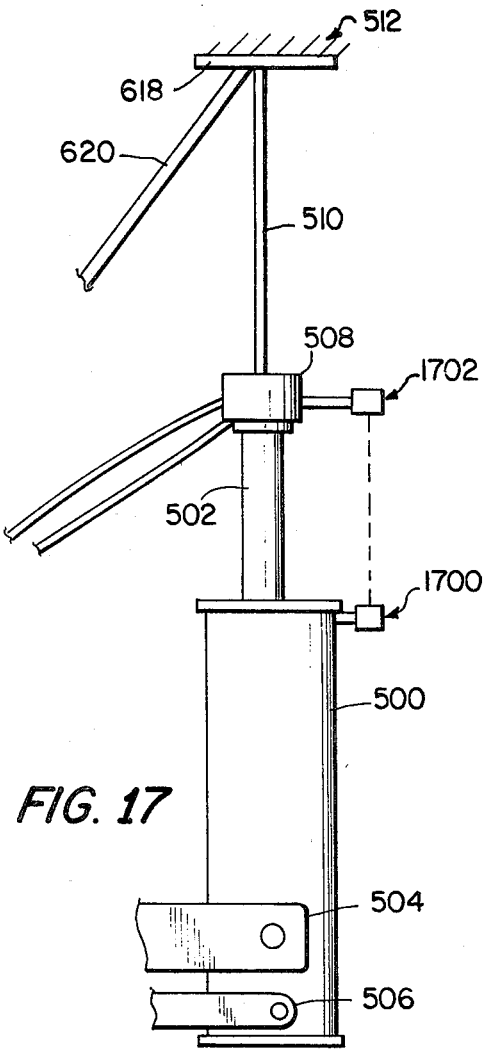
FIG. 17 is a partial elevation of a particular commercially available roof-bolting machine, with modifications according to the fifth embodiment of the invention.

FIG. 17 shows a FLETCHER roof bolter discussed above with reference to FIG. 12. However, in FIG. 17, a radiation source 1700 and detector 1702 are connected to the roof bolter in place of the spring loaded drum 524 and cable 520 shown in FIG. 12. Source 1700 can be, for example, an infrared source which emits electromagnetic radiation toward detector 1702. Source 1700 and detector 1702 are shown in greater detail in FIG. 19 where it can be seen that source 1700 comprises a housing 1708 which mounts infrared radiation emitting element 1710. Element 710 can include any necessary reflectors or the like to ensure that the beam emitted from the source will be directed toward detector 1702. Element 1710 is connected by electrical leads 1712 to any available electrical source. Detector 1702 includes a photodetector 1716. Photodetector 716 may be either a photoconductive cell or a photovoltaic cell. The output of cell 1716 is connected to control circuit 1718 which, in turn, is connected to a solenoid valve 1720. The intensity of the radiation from source 1700 which strikes element 1716 will vary in a well known manner in accordance with the distance between source 1700 and detector 1702. Accordingly, the output signal from detector 1702 will also vary in accordance with the change in this illumination. Clearly, when the source 1700 and detector 1702 are at a point of least separation, the intensity of the light striking detector 1716 and the output of detector 1716 will be the greatest. When the source 1700 and detector 1702 are separated, the light intensity striking detector 1716 and the output from detector 1716 will decrease. The relationship between the intensity of the radiation striking detector element 1716 and the distance between source 1700 and detector 1702 is given by the formula:

$$r=(I/I_0)^{\frac{1}{2}}r_0$$

where r indicates the present separation, I indicates the present intensity, $I_0$ indicates the maximum intensity measured at the least separation, and $r_0$ indicates the distance between the source and detector at least separation.

The distance between source 1700 and detector 1702 is an indirect measurement of the length of pinning rod 510. As the distance between source 1700 and detector 1702 becomes greater, the length of pinning rod 510 which is exposed becomes less, and the force which can be applied to the pinning rod increases. A control circuit 1718 is provided which produces a drive signal which increases in value as the distance between source 1700 and detector 1702 decreases. Control circuit 1718 can also include amplifiers for increasing the level of the drive signal to an amount sufficient to drive solenoid valve 1720. Solenoid valve 1720 will be opened by an amount determined by the drive signal from control circuit 1718 and can be substituted for relief valve 40 in a circuit similar to that of FIG. 6 to control the pressure used for the extension of, in this case, piston 502. Control circuit 1718 can also include shaping circuitry so that the output to valve 1720 is a non-linear function of the input so that the force-vs.-displacement curve of the system resembles that shown in FIG. 9. The construction of such circuitry would be apparent to one of ordinary skill in the art and is not the subject of the present invention.

Figure 18:
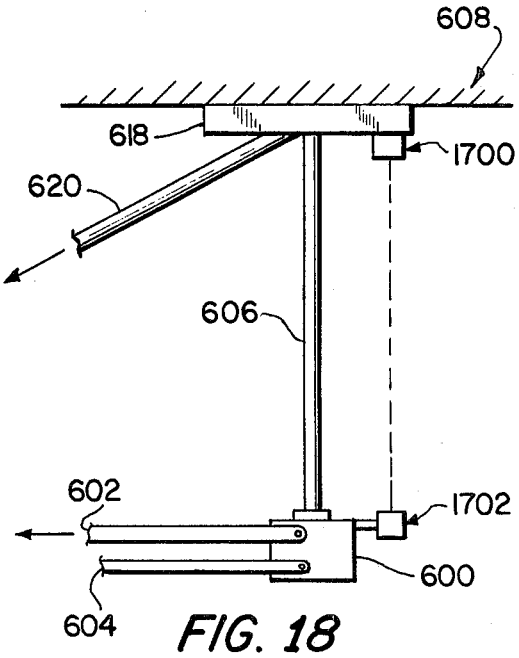
FIG. 18 is a partial elevation of a particular commercially available roof-bolting machine with modifications according to the fifth embodiment of the invention.

FIG. 18 shows a conventional type roof bolting machine discussed above with reference to FIG. 13. The roof bolting machine of FIG. 18 is equipped with source 1700 and detector 1702 of the present invention. However, since the torque motor of the bolting machine of FIG. 18 is moved vertically by boom members 602 and 604, the source 1700 is connected to temporary roof support 618 and detector 1702 is connected to the hydraulic motor 600. Accordingly, the configuration of FIG. 18 provides a direct measurement of the length of the pinning rod 606 exposed below roof 608 as opposed to the configuration of FIG. 17 in which the reading is an indirect measure of the exposed length of pinning rod 510. Consequently, when used with the bolting machine of FIG. 18, control circuit 1718 could produce a drive signal which decreases in valve as the distance between source 1700 and detector 1702 decreases so that, as source 1700 and detector 1702 approach one another, the force applied to pinning rod 606 is increased due to solenoid valve 1720 being more fully closed.

If desired a redundancy reading can be made using the FLETCHER bolter of FIG. 17 by using a second source 1700 on the temporary roof support 618 used with the bolter. Of course a second detector element would be required in detector 1702 to receive the second source.

Figure 20:
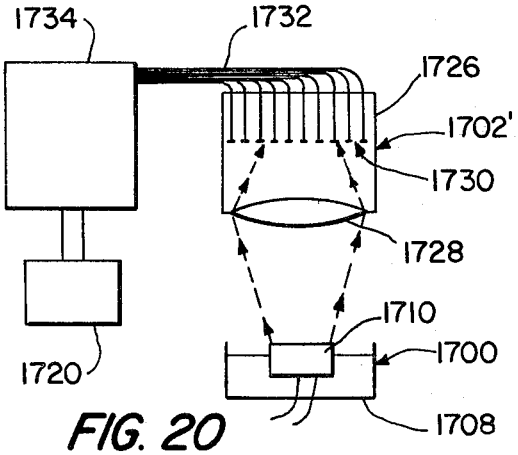
FIG. 20 shows a second source-detector combination which can be used with the fifth embodiment of the invention.
Figure 19:
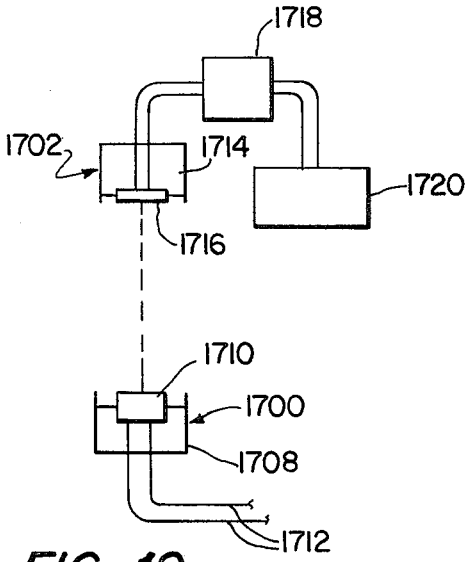
FIG. 19 shows one source-detector combination which can be used in the fifth embodiment of the invention.
Figure 21:
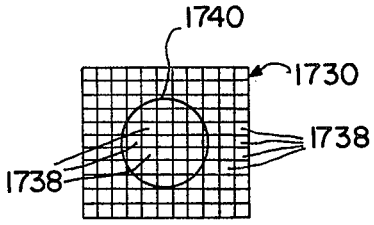
FIG. 21 is a top plan view of the detector mosaic used in the detector of FIG. 20.

FIG. 20 shows source 1700 used with an alternative detector 1702'. Detector 1702' includes a mosaic of detector elements 1730 disposed within housing 1726. Radiation from source 1700 is focused on the array by a far field lens 1728. FIG. 21 shows the mosaic 1730 in plan view. Mosaic 1730 contains a plurality of detecting elements 1738 disposed immediately adjacent one another. The rays from source 1700 will be focused on only a portion of the element 1738 as shown by circle 1740. Accordingly, the number of such elements which receive the rays can be counted to indicate the distance from source 1700 to detector 1702'. As this distance increases, the circle of radiation 1740 will decrease in size and as the distance decreases, the circle of radiation 1740 will increase in size. Processing circuitry 1734 is connected to bus 1732 which contains a lead from each of the detectors 1738 of mosaic 1730. Processing circuitry 1734 can contain a multiplexer for individually accessing each of the elements 1738, a counter for counting the number of elements which produce an output indicative of radiation impinging on those elements, and a digital-to-analog converter for converting the output of the counter to an analog voltage for controlling solenoid valve 1720. Alternatively, a microprocessor can be used in circuit 1734 to perform all of these functions. The construction of the circuit 1734 would be obvious to one of ordinary skill in the art and is not the subject of the present invention.

Detector 1702 provides a more accurate indication of the distance between the source 700 and detector 1702. If desired, the number of elements in mosaic 1730 can be reduced. However, a large number of elements is desirable in order to compensate for any misalignment of the source and detector which would place radiation circle 1740 off center. Also, in theory, only one row of elements 1738 need be used in mosaic 1730. However, also for the reason that misalignment may occur, it is desirable to have a mosaic comprised of a matrix having a plurality of rows and a plurality of columns.

While preferred arrangements of the invention have been described above in detail, it is to be noted that further modifications will become apparent to those skilled in the art. Therefore, the scope of protection is to be defined by the following claims.

What is claimed is:

1. An apparatus for use with an underground mine roof-bolting machine having a torque motor, a pinning rod held for rotation by said torque motor, and controllable means for applying an upward thrust on said torque motor for inserting said pinning rod into a mine roof, said apparatus comprising:

a source for projecting a beam of radiation;

detector means for detecting said beam and producing an output signal in response thereto;

wherein one of said source and said detector means is mounted stationary with respect to said torque motor and the other of said source and detector means is mounted for upward movement with said torque motor; and thrust control means connected to receive the output of said detector means and connected to said controllable means for controlling the amount of upward thrust exerted by said controllable means in response to the level of said output signal.

2. The apparatus as set forth in claim 1, wherein said source is a source of infrared energy.

3. The apparatus as set forth in claim 1, wherein said detector means comprises a photodetector element and said output is a signal indicative of the illuminance received by said photodetector element, said thrust control means being responsive to said output to control the upward thrust of said torque motor in accordance with the illuminance received by said detector means.

4. The apparatus as set forth in claim 1, wherein said detector means comprises a plurality of detector elements and wherein said thrust control means includes means for counting the number of said detector elements receiving radiation from said source.

5. The apparatus as set forth in claim 4, wherein said plurality of detector elements are arranged in a matrix having a plurality of rows and a plurality of columns.

6. The apparatus as set forth in claim 4, and further including a lens element connected between said source and said detector means for focusing radiation from said source on said detector means.

7. The apparatus as set forth in claim 1, wherein said controllable means comprises a fluid cylinder having a movable piston connected to said torque motor, and wherein one of said source and said detector means is connected to said torque motor and the other of said source and said detector means is connected to said cylinder.

8. The apparatus as set forth in claim 1, wherein said apparatus also includes a temporary roof support disposed above said torque motor and wherein one of said source and said detector means is connected to said torque motor and the other of said support and said detector means is connected to said temporary roof support.

* * * * *